United States Patent [19]

Fenwick

[11] 4,148,535

[45] Apr. 10, 1979

[54] MODULAR DISPLAY CASES

[75] Inventor: Jay G. Fenwick, Albert Lea, Minn.

[73] Assignee: Litton Business Systems, Inc., Beverly Hills, Calif.

[21] Appl. No.: 774,835

[22] Filed: Mar. 7, 1977

[51] Int. Cl.[2] ..... A47B 47/00; A47B 95/00

[52] U.S. Cl. ..... 312/304; 16/95 R; 49/410; 312/257 R

[58] Field of Search ..... 108/108, 109, 110; 312/304, 307, 138 R, 257 R; 211/94, 94.5; 49/409, 410, 411; 16/87 B, 87.4 R, 90, 91, 94 R, 94 D, 95 R, 95 D, 96 R, 96 D

[56] References Cited

U.S. PATENT DOCUMENTS

| | | | |
|---|---|---|---|
| 3,339,749 | 9/1967 | Odegaard et al. | 211/94 |
| 3,485,545 | 12/1969 | Newman et al. | 312/258 |
| 3,563,626 | 2/1971 | Ferdinand et al. | 108/108 |
| 3,601,462 | 8/1971 | Fenwick | 312/138 |
| 3,636,661 | 1/1972 | Strawsine | 312/304 |

*Primary Examiner*—Mervin Stein
*Assistant Examiner*—Alex Grosz
*Attorney, Agent, or Firm*—Robert E. Lowe

[57] ABSTRACT

A system for constructing modular display and storage cases is disclosed in which the cases are built up from standard shelving. The shelving includes a vertical slot near the front face for engaging a selected mounting element, which in turn provide support for the door panels of the unit. Side panels are attached to complete the structure. Using the same shelves and mounting elements a wide variety of different display and storage case configurations can be constructed.

2 Claims, 6 Drawing Figures

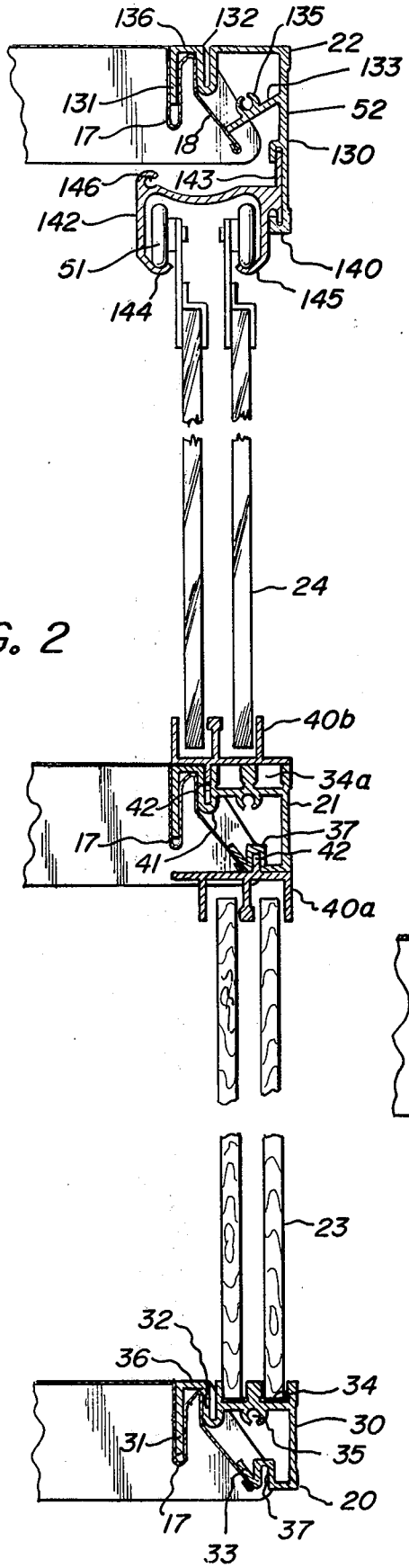
FIG. 2
FIG. 3
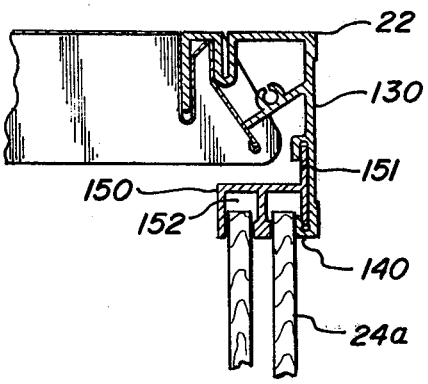
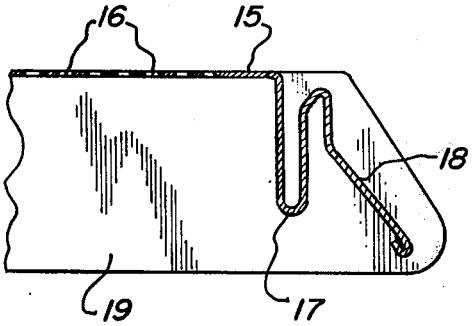
FIG. 6

MODULAR DISPLAY CASES

BACKGROUND OF THE INVENTION

This invention relates to the field of store fixtures, and more particularly to the various types of closeable display or storage cases used in retail stores.

Every retail store uses a variety of fixtures to display its merchandise for sale. Thus some merchandise may be displayed on tables, while other merchandise may be displayed on open shelves either arranged along the walls or as a component part of free standing "gondolas". Some units provide open shelves in the top portion for displaying merchandise and a closed storage compartment in the lower half of the unit. Frequently considerations of theft and security must be taken into account and in such cases it is typical to display merchandise in a closed limited access case of some type.

Heretofore each of the above kinds of display units has been manufactured as a unique item to fit the particular purpose involved. This practice requires store fixture manufactures to stock a large variety of different cases, or at least to provide for their manufacture on a specialized or batch basis. Clearly these practices significantly add to the cost of the times which is ultimately reflected in their selling price. There has long been a need, therefore, to develop a system whereby these various types of display cases can be manufactured from standard components and assembled "on site" to accommodate the needs of that particular location.

SUMMARY OF THE INVENTION

The present invention seeks to solve the problems mentioned above, and does so by providing a shelf of unique construction which is adaptable to serve as a base for the build up of modular display case units. A number of complementary interlocking elements are also provided which, when used in conjunction with the shelf, allow for the construction of a number of different display case units.

BRIEF DESCRIPTION OF THE DRAWINGS

The invention will be further described by reference to the drawings in which

FIG. 2 is a fragmentary cross-section of the display case shown in FIG. 1 taken along line 2—2;

FIG. 3 is a fragmentary view partially in cross-section of a modification of the construction shown in FIG. 2;

FIG. 6 is a cross-sectional view of a portion of the shelf used in the present invention.

DESCRIPTION OF PREFERRED EMBODIMENTS

Figure 1:
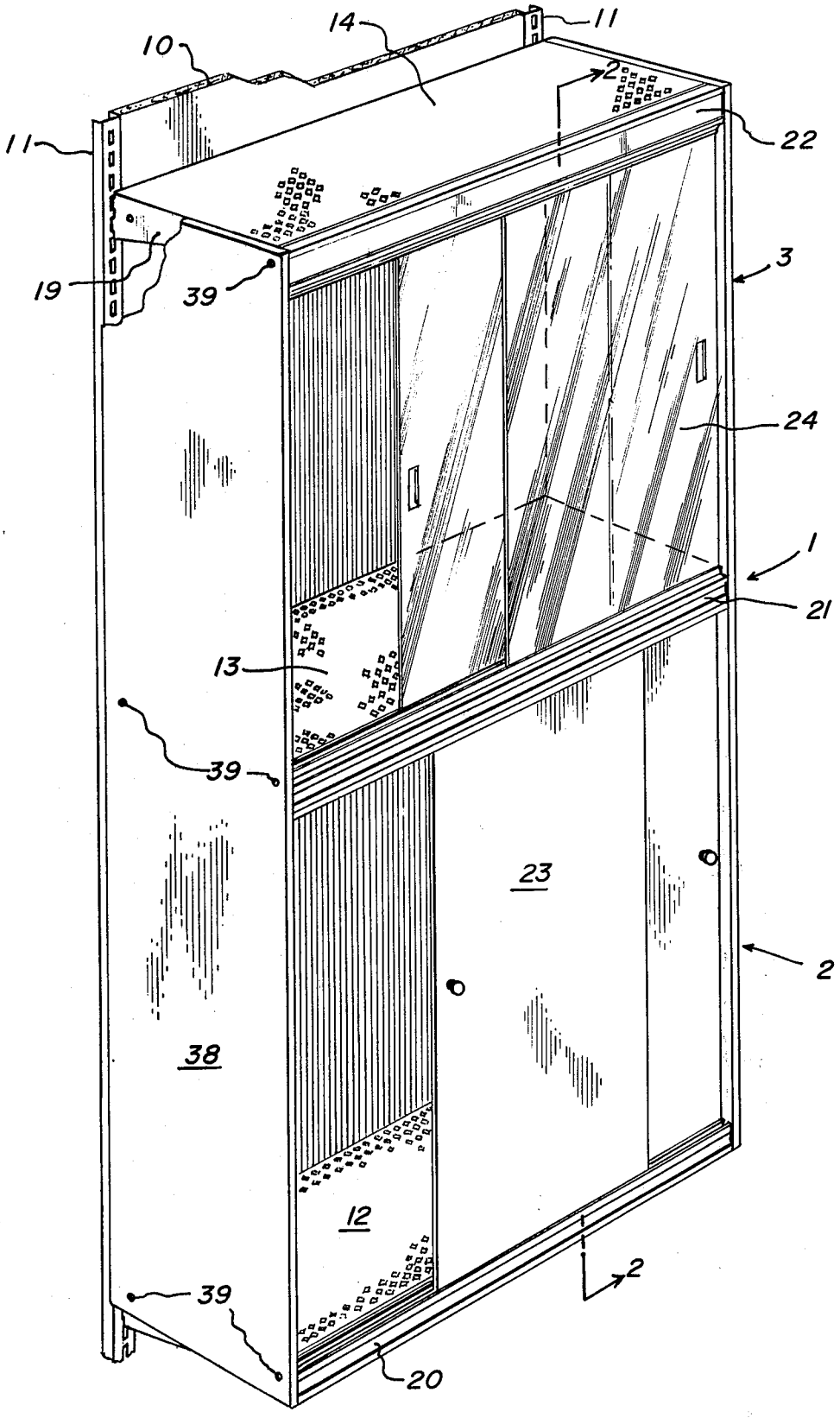
FIG. 1 is a perspective view of a two part display case incorporating the elements of the present invention.

FIG. 1 illustrates a display case 1 consisting of a lower half 2 and an upper half 3. While the display case shown consists of two separate portions, it will be understood that the case could comprise a single unit or three or more units depending upon the particular desired result. The same principles and elements of the present invention would simply be employed in greater or lesser number as appropriate.

A wall 10 provides the support basis for the unit and standards 11 are mounted to the wall 10. It will be understood that the term "wall" encompasses both a structural wall of a room as well as the free standing wall provided as an integral portion of a gondola as is well-known to those in the field of store fixturing.

The display case 1 is built up from shelves 12, 13, and 14, the number and spacing of which determine the size of the case 1 as well as the number of units into which it may be divided. In the case illustrated in FIG. 1 three shelves have been used, 12 providing the bottom of the case, 14 providing the top, and shelf 13 serving the dual function of dividing the case into two units and as the bottom of upper half 3.

Attached to the forward edge of each of the shelves 12, 13 and 14 is a mounting element 20, 21 and 22 respectively. The mounting elements in each case provide the necessary support and guide means for the doors 23 and 24. The precise construction of each of elements 20, 21 and 22 and the manner in which it performs its function is more clearly illustrated in FIG. 2.

Figure 4:
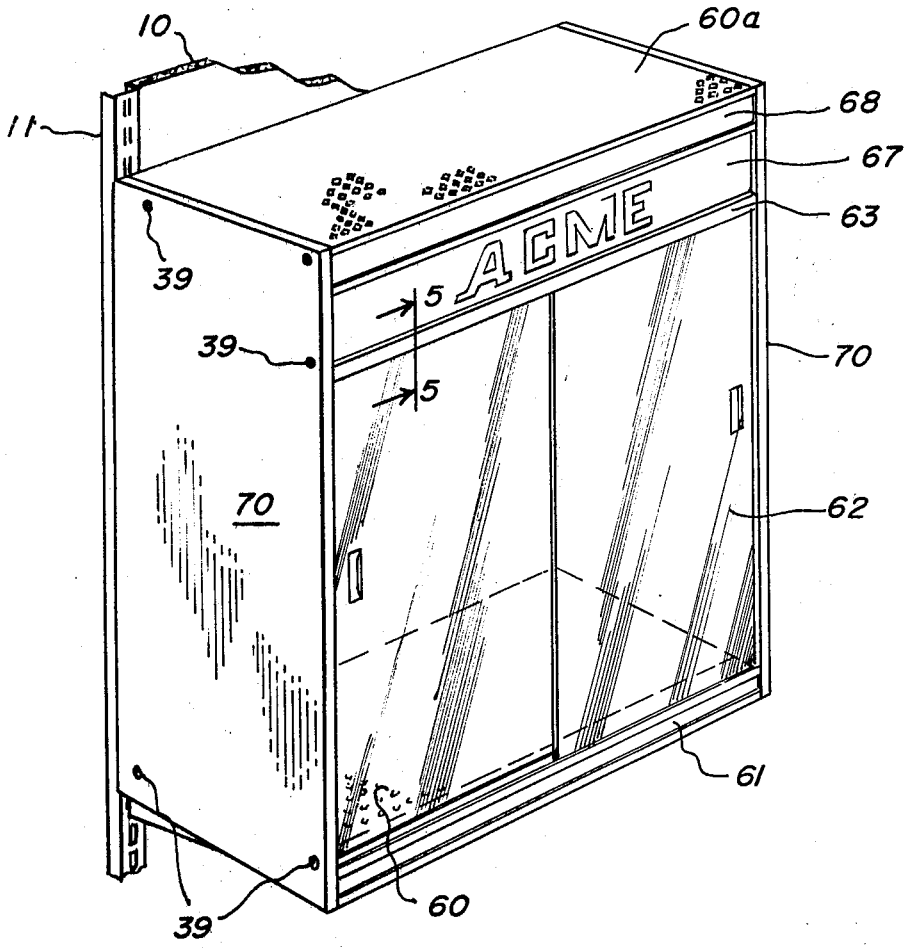
FIG. 4 is a perspective view of a different type of display case constructed from the elements of the invention.

An understanding of the detailed construction of the shelves 12, 13 and 14 is necessary to a clear understanding of the operation of the invention. It will be understood that although each of the shelves has been assigned a distinct number for purposes of description, the shelves 12, 13 and 14 are actually identical to one another and completely interchangeable in the practice of the invention. As well as being identical to one another, it is also an object of the invention that the shelves 12, 13 and 14 be identical to all of the other shelving used in the particular store installation. In other words, it is contemplated that shelves like 12, 13 and 14 be provided as standard in a given installation so that enclosed display cases such as shown in FIGS. 1 and 4 may be constructed as desired by simply adding the remaining mounting elements.

The fragmentary cross-section of the shelf 12 shown at FIG. 6 illustrates the shelf pan portion 15 having a plurality of diamond shaped perforations 16 therein. A deep slot 17 is formed at the forward edge of pan portion 15 and rearwardly adjacent the shelf front 18. The shelf pan 15 is fixed at each end to a bracket 19 which adds structural strength as well as providing the means for attaching the shelf to the standards 11. The incorporation of the slot 17 into the shelf design is believed to be unique in the art and provides the basic structural characteristic upon which the remaining construction elements can be built. While the precise depth of the slot can be varied somewhat to be proportional to the overall shelf dimensions, it should be noted that the slot extends along a substantial portion of the overall height of the shelf. For most applications in the present invention it is preferred that the slot 17 have a depth of about 1"-1½" and extend substantially across the full width of the shelf.

Mounting elements of various configurations, such as those shown at 20, 21 and 22 in FIG. 1, are provided to at least partially engage the slot 17 in each shelf to provide an appropriately configured structure for the operable mounting of various doors and other hardware. The mounting elements are preferably extruded aluminum which is well-suited to high volume manufacture in a relatively economical manner.

Referring to FIG. 2, the precise make-up of various mounting elements is depicted. For example, element 20 includes a vertical face portion 30 which may be finished in a variety of decorative styles and finishes as it is the face portion 30 that is largely visible when the completed display case is assembled. The rearward portion of the element 20 comprises an inverted U-portion 36 forward of a rear leg 31 and a forward leg 32. The rear leg 31 is somewhat longer that the forward leg 32 and in general is sized to fit snugly into slot 17 in the shelf 12. A generally horizontally extending leg 33 projects rearwardly from the bottom edge of face portion 30 and is sized to rest upon the shelf front 18. An inverted U-portion 37 is formed in the leg 33, the function of which will be described hereinafter.

The top surface of element 20 is formed to provide a pair of parallel tracks 34 which are sized to accommodate the door panels 23 and to allow the door panels to slide in the tracks. A semi-circular groove 35 is provided to receive threaded fasteners 39 to hold side panels 38 in place.

It can be seen that mounting element 21 is in fact identical to element 20 in its configuration. Two additional elements **40*a* and 40*b* have been added to element 21 in order to create the structure in the central region of display case 1. The mounting elements to 40*a* and 40*b* are essentially E-shaped, each comprising a pair of parallel channels adapted to accommodate a door panel such as panel 23 or panel 24. A leg portion 42 extends outwardly from the side opposite the channels and serves to attach the elements 40*a* and 40*b* to the mounting element 21**.

To form the central portion of the display case shown in FIG. 1, a first mounting element **40*a* is attached to the underside of element 21 by inserting the leg portion of element 40*a* into the inverted U-portion 37 of element 21. The leg 42 is dimensioned to fit snugly into the U-portion and be supported thereby. A second element 40*b*, which has been inverted relative to the first element 40*a* is mounted to the top side of mounting element 21 by inserting the leg portion 42 into the channel 41 formed between the forward leg 32 and the wall of the track 34*a***.

In many applications the lower edge of door panels 24 may ride in tracks **34*a* of element 21 directly, in which case the mounting element 40*b* would not be used. However, in the particular embodiment illustrated in FIGS. 1 and 2, the upper door panels 24 are of the type which are hung from tracks 144 and 145 by means of rollers 51 which causes the bottom edges of the door panels 24 to be laterally offset from the tracks 34*a*. Element 40*b*** is included in this particular configuration to compensate for such offset.

In order to form the uppermost portion of the display case 1, a third shelf 14, which is identical to the other shelves 12 and 13, is used in conjunction with mounting element 22 which is configured somewhat differently than elements 20 and 21. Some portions of element 22 are very similar to and correspond to like portions of elements 20 and 21. That is, an inverted U-shaped portion 136 is provided having legs 131 and 132, leg 131 being adapted to snugly fit into slot 17 of the shelf 14. A rearwardly extendingly leg 133 is adapted to engage the shelf front 18 as well as incorporating groove 135 which is provided to engage threaded fastener means 39. The face portion 130 can be finished as desired for esthetic appearance.

A rearwardly faced channel 140 is provided on the back side of face portion 130. A roller track element 142 includes a T-shaped portion 143 adapted to slide into the channel 140. The element 142 provides a pair of tracks 144 and 145 which are shaped to accomodate rollers 51. The rollers are in turn rigidly mounted to the door panels 24 so that in the completed assembly the door panels 24 are suspended from and roll along tracks 144 and 145. In order to increase structural rigidity, groove 146 provides an additional receiving means for a threaded fastener.

Another embodiment of the structure of the uppermost portion of the display case is shown in FIG. 3. In this embodiment the same basic mounting element 22 is employed, having a face portion 130 and a rearwardly faced channel 140. In place of roller track element 142, a sliding track element 150 has been substituted. The element 150 would be used when bottom supported sliding doors, such as doors 23, are used for the top half of the case. The element 150 includes a T-shaped portion 151 for engagement with channel 140 and a pair of parallel tracks 152 for guiding the top edges of door panels **24*a***.

Figure 5:
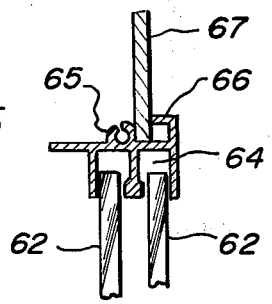
FIG. 5 is a fragmentary cross-sectional view taken along line 5—5 of FIG. 4.

A still further embodiment of the invention is shown in FIGS. 4 and 5. In some applications it is desirable to provide a large sign board area for listing the brand name of the products displayed or other information. The embodiment shown in FIGS. 4 and 5 is particularly wellsuited to that purpose.

Shelves 60 and **60*a* provide the top and bottom of the unit, these shelves being of identical construction as shelves 12, 13 and 14 previously described. Mounting element 61 attached to the front edge of shelf 60 provides the base support for door panels 62 shown as glass in FIG. 4. Mounting element 61 is identical in configuration to mounting elements 20 and 21** previously described.

Support element 63 is provided to support and guide the upper edges of the door panels 62. As shown in FIG. 5, support element 63 includes a pair of parallel tracks 64, a semi-circular slot 65, and a rearwardly extending leg 66. The slot 65 and leg 66 are spaced to form a channel therebetween for receiving a sign board 67.

Shelf **60*a* is spaced above support element 63 a distance corresponding to the height of sign board 67 and includes a mounting element 68 attached to the front edge thereof. The mounting element 68 is identical in configuration to mounting element 22 described previously. Since the sign board 67 is stationary, additional track elements such as 142 and 150** are not used in this embodiment.

The support element 63 is held in place by threaded fasteners 39 inserted through side panel 70 into the slot 65. Additional fasteners 39 are spaced at appropriate locations around the periphery of the side panel to hold it in place.

The present invention therefore provides for the building, in a modular fashion, a large variety of display and storage cases fully adaptable to special requirements. Shelving is generally provided in standard widths of 30", 36" and 48" in the industry. Thus by selecting the shelf width and then the distance between vertically adjacent shelves, cases of many different sizes can be constructed. The cases can be positioned at selected heights and through the appropriate selection of mounting elements single or multiple vertically adjacent cases can be constructed, and the type of door can be selectively varied. The need to build unique cases for each application is eliminated and the cases can be built from standard parts.

While in the foregoing specification the invention has been described in considerable detail for purposes of completeness, it will be understood that many variations and modifications can be made by those skilled in the art without departing from the scope of the appended claims.

I claim:

1. A display case comprising first and second shelves including bracket means for attaching said shelves to wall standards, said first shelf forming the bottom surface of said case, said second shelf forming the top surface of said case, said first and second shelves each including a vertically aligned slot adjacent the front face thereof; first mounting means removeably attached to said first shelf through attaching engagement of a portion of said mounting means with said slot, said first mounting means including a pair of parallel tracks for receiving first and second door panels; second mounting means removeably attached to said second shelf through attaching engagement of a portion of said mounting means with said slot, said second mounting means including channel means for receiving removable track means, said track means adapted to engage said first and second door panels, and side panel means adapted for attachment to said shelves.

2. A modular display fixture apparatus providing for the construction of a plurality of different display cases from preselected elements, said apparatus comprising:

(a) shelf means having bracket means for attaching said shelf means to vertical standards, said shelf means including a deep, downwardly extending slot adjacent the front face thereof, said front face including a downwardly slanted surface;

(b) a plurality of selectable mounting elements engageable with said slot for affixation to said shelf means, said elements including channel means for receiving removable track means and a leg portion resting upon and supported by the downwardly slanted surface of the front face of said shelf means;

(c) a plurality of selectable track means engageable with said mounting element channel means;

(d) door panel means slideably mounted in said track means; and (e) side panel means adapted for affixation to said shelf means and said mounting elements.

* * * * *